US007213635B2

(12) United States Patent
Persson

(10) Patent No.: US 7,213,635 B2
(45) Date of Patent: May 8, 2007

(54) HEAT EXCHANGER WITH REINFORCEMENT MEANS

(75) Inventor: Lars Persson, Ystad (SE)

(73) Assignee: EP Technology AB, Malmo (SE)

( * ) Notice: Subject to any disclaimer, the term of this patent is extended or adjusted under 35 U.S.C. 154(b) by 85 days.

(21) Appl. No.: 10/532,502

(22) PCT Filed: Oct. 31, 2003

(86) PCT No.: PCT/SE03/01686

§ 371 (c)(1),
(2), (4) Date: Apr. 25, 2005

(87) PCT Pub. No.: WO2004/040224

PCT Pub. Date: May 13, 2004

(65) Prior Publication Data

US 2006/0048917 A1 Mar. 9, 2006

(30) Foreign Application Priority Data

Nov. 1, 2002 (SE) ..... 0203214

(51) Int. Cl.
*F28F 3/02* (2006.01)

(52) U.S. Cl. ..... 165/78; 165/167; 165/906

(58) Field of Classification Search ..... 165/78, 165/167, 906, 166
See application file for complete search history.

(56) References Cited

U.S. PATENT DOCUMENTS 1,635,838 A * 7/1927 Haber ..... 165/166
2,648,527 A * 8/1953 Carnahan ..... 165/167
3,444,926 A 5/1969 StÅlberg
3,476,178 A 11/1969 Härting
3,532,161 A * 10/1970 Loebel ..... 165/167
4,249,597 A * 2/1981 Carey ..... 165/166
5,063,995 A 11/1991 Förster et al.
5,184,673 A * 2/1993 Hedman et al. ..... 165/153
5,325,915 A * 7/1994 Fouts et al. ..... 165/78
5,435,383 A 7/1995 Rajagopal
5,492,171 A 2/1996 Källrot
5,992,510 A 11/1999 Källrot
6,161,615 A 12/2000 Brieden et al.
6,564,862 B1 5/2003 Persson

FOREIGN PATENT DOCUMENTS

FR 859 510 12/1940
GB 249 184 3/1926

OTHER PUBLICATIONS

U.S. Appl. No. 10/532,502, filed Apr. 25, 2005, Persson.
U.S. Appl. No. 10/544,024, filed Jul. 29, 2005, Persson.
U.S. Appl. No. 09/380,080, filed Nov. 15, 1999, Persson.

* cited by examiner

*Primary Examiner*—Teresa J. Walberg
(74) *Attorney, Agent, or Firm*—Oblon, Spivak, McClelland, Maier & Neustadt, P.C.

(57) ABSTRACT

A heat exchanger including plates with a pattern of grooves and connections for inlets and outlets. The plates are placed in a pack and brazed so that separate channels for two media area are formed between alternating pair of plates. A set of holes is arranged in the plates around the connections, and a reinforcement mechanism is arranged through the holes.

9 Claims, 4 Drawing Sheets

HEAT EXCHANGER WITH REINFORCEMENT MEANS

FIELD OF THE INVENTION

The present invention refers to a heat exchanger with reinforcement means arranged through the plates of the heat exchanger and especially to a heat exchanger with reinforcement means arranged around the respective connection.

BACKGROUND OF THE INVENTION

The fully brazed heat exchangers of today comprise of brazed packs of plates. A drawback with these brazed heat exchangers are that it is not possible to manufacture large heat exchangers having connections with large inlets and outlets, e.g. with a diameter of about 150 millimeters, in order to increase e.g. the process speed, since the design process pressure, i.e. the maximum process pressure the heat exchanger is designed for, which often is about 150 bar at bursting test, give rise to large forces which can cause the brazings to break and leakage to occur. The leakage can both cause the media in the heat exchanger to be mixed and that one or both of the media leak out from the heat exchanger.

Another type of heat exchanger is the seal type heat exchanger, which is held together by screw joints, with seals between the heat exchanger plates. A drawback with this type of heat exchanger is that they only can be used at low pressures, i.e. at process pressure up to about 50 bar. Further, the heat exchanger seals will age and have to be replaced at regular intervals. Another drawback is that the screw joints are arranged around the heat exchanger in order to hold the plates together, which give rise to large deflections at the connections which in turn leads to leakage in the gaps created due to the deflections.

In order to avoid these problems in a heat exchanger having large dimensions it would require thicker plates having plate thickness about 100 millimeters in order to handle the design process pressure of 150 bar at bursting test, resulting in that a heat exchanger consisting of a number of plates is unpractical and unnecessarily large.

The present invention solves the above problem with leakage from a heat exchanger due to breakage of the brazings in a fully brazed heat exchanger by arranging reinforcement means through the plates around the respective connection, whereby a normal plate thickness of about 2–3 millimeters is sufficient to resist the increased forces.

SUMMARY OF THE INVENTION

The present invention thus provides a heat exchanger comprising plates having a pattern of grooves and inlet and outlet connections. The plates are placed so as to form a pack and brazed together so as to form separate channels for two media between alternating pair of plates. Further, according to the invention reinforcement means are arranged around respective connection.

The present invention is defined in claim 1. Preferred embodiments of the invention are set forth in detail in the dependent claims.

BRIEF DESCRIPTION OF THE DRAWINGS

The present invention will be described in further detail with reference to the accompanying drawings, in which.

DETAILED DESCRIPTION OF PREFERRED EMBODIMENTS

Figure 1:
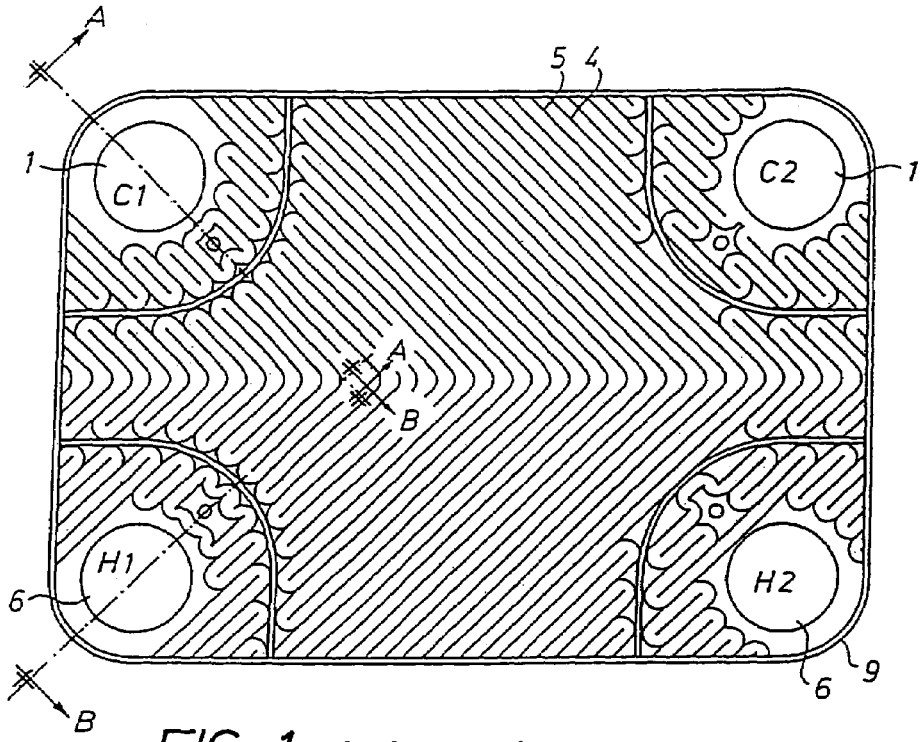
FIG. 1 (prior art)
FIG. 1 shows top view of a plate for a heat exchanger according to the prior art.

FIG. 1 shows a plate for a heat exchanger according to prior art. As conventional, the plate has connections 1, 6 and a groove pattern with peaks 4 and valleys 5. A cold medium has an inlet at C2 and an outlet at C1, and a hot medium has an inlet at H2 and an outlet at H1.

A heat exchanger is created by assembling a number of identical plates into a pack Preferably every other plate is turned 180° so as to create a crossing pattern and to form channels for the media between alternating pair of plates, as is well known to those skilled in the art. Furthermore, on one side of the pack a bottom plate is arranged (see reference numeral 42 in FIG. 4) for closing the connections 1, 6 on one side. In cross section, a honeycomb-like pattern is created. The whole pack is brazed together in an oven so as to create brazing points where peaks cross each other. Furthermore, every other pair of plates is brazed together at the connections 1, 6.

In a conventional heat exchanger, the plates usually have dimensions about 500 mm×300 mm (length×width), and the inlets and outlets, respectively, at the connections 1, 6 have a diameter of about 50–70 mm. Should a conventional heat exchanger be made larger, e.g. with the plate dimensions 1200×530 mm (length×width), and with connections having inlets and outlets of a diameter about 150 mm, in order to increase the process speed, so large forces, due to the increased pressure, would be exerted on the brazings at the connections 1, 6 there is a risk that the brazings would break. A common design process pressure is about 150 bar. It will be understood that if such a brazing breaks the medium in the connection 1,6 will leak from the heat exchanger.

The present inventor has realized that the problem can be solved by an arrangement, which will be described below.

Figure 2:
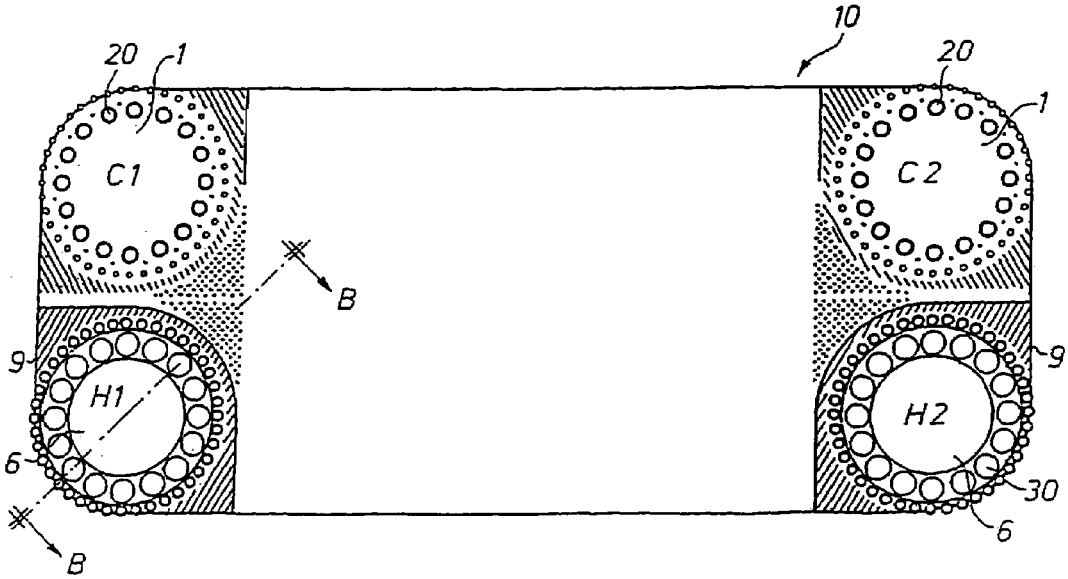
FIG. 2 schematically shows a top view of an embodiment of a plate for a heat exchanger according to the present invention.

In FIG. 2 is schematically shown an embodiment of a plate 10 for a heat exchanger according to the present invention. The components in the FIG. 2 corresponding to components in FIG. 1 are indicated with the same reference numerals. In FIG. 2, the interior of the plate is not shown but it should be understood that the groove pattern could be varied in several ways without falling outside the scope of the invention. Further, in FIG. 2 an embodiment of a plate is shown having dimensions of about 1200 mm×520 mm and having connections 1, 6 with inlets and outlets, respectively, with a diameter larger than what is common. According to this embodiment the inlet and outlet of the connections 1, 6 have a diameter of about 150 millimeter, which is considerably larger than the diameter of the inlet and outlet of conventional connections, which is about 50 millimeter.

The problem of leakage due to break of brazings at the connection, the present inventor has solved by arranging a number of holes 20 through the plates 10 around each connection 1, 6, in which holes 20 reinforcement means 30 are arranged as a complement and reinforcement to the brazings at the connections 1, 6. FIG. 2 shows the holes 20 at the connections 1 and an end of the reinforcement means 30 at the connections 6 when they are arranged in the holes 20.

The holes 20 are preferably placed in rotational symmetry since every other plates is turned 180° and arranged around the connections 1, 6 to further reduce the force impact on the brazings. FIG. 2 shows 16 holes arranged around each connection, but it should be understood that the number of holes could be varied in dependence on e.g. the reinforcement of the brazings that is required to avoid the leakage problem.

The reinforcement means 30 can be designed as e.g. threaded rods or bolts with a diameter adapted to the diameter of the holes 20, whereby the reinforcement means 30 can be arranged in the holes 20. Further, stops, e.g. nuts or the like, can be arranged at the ends of the reinforcement means 30 in order to fix the reinforcement means 30 to the pack. However, it should be understood that the reinforcement means can be designed as a screw having a head in its first end, which head functions as the above mentioned stop and a nut can be arranged at the second end of the reinforcement means 30.

An embodiment of the invention comprises a ring, disc or plate having one or several threaded holes, whereby the reinforcement means are inserted through the holes of the plates and are fixed to the plates by screwing the second end of the reinforcement means in said threaded holes. Thus, said ring, disc or plate is arranged to secure several reinforcement means at said pack of plates.

Figure 3:
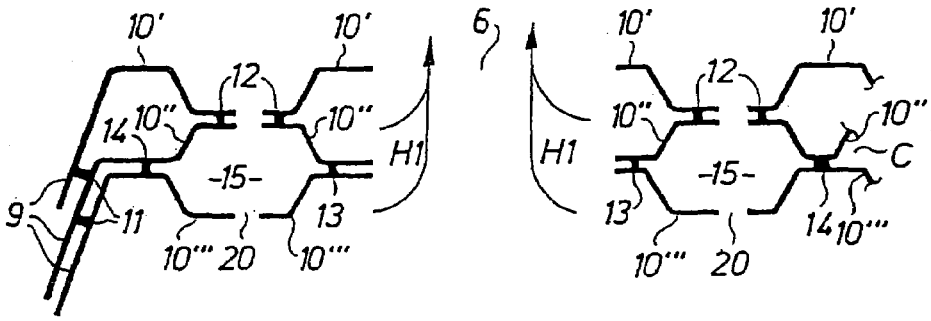
FIG. 3 schematically shows a partial cross-section of three plates taken along the line B—B in FIG. 2.
Figure 4:
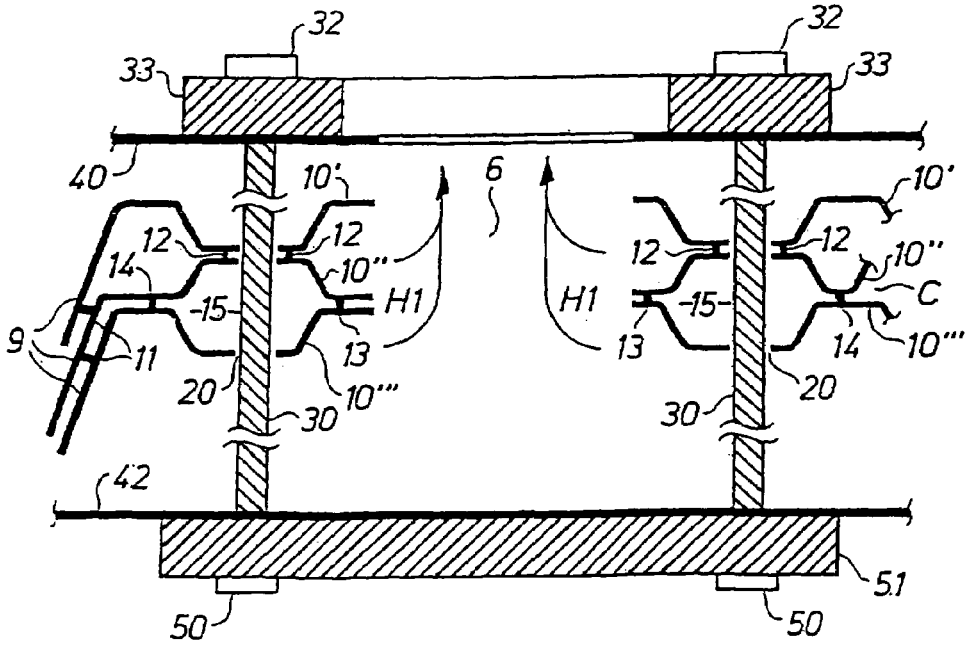
FIG. 4 shows the three plates according to FIG. 3 and a reinforcement means according to an embodiment of the present invention.

FIGS. 3 and 4 show a schematically cross-section, not according to scale, of three plates 10 at an outlet 6, where a medium H1 flows out. The cross-section is taken along the line B—B in FIG. 2. Brazings are shown as at 11. Arrows show the exit of medium H1. The medium H1 arrives from channels created between alternating pairs of plates. The figures show two plates 10', 10" of one pair and the upper plate 10'" of the next pair. The second medium flows in channels between the intermediate pairs, i.e. the two lower plates 10", 10'", etc.

As shown in FIGS. 3 and 4 the plates 10 preferably show valleys and peaks, respectively, at the holes 20 in order to increase the brazing surface between a lower plate 10" in one pair and an upper plate 10'" in the next pair. The brazing at the plane peaks is denoted by 12. The brazing 12 extends sealingly around the hole 20. The brazings 13 and 14 are further shown, which brazings braze the lower plate 10" of the pair with the upper plate 10'" in the next pair. The brazing 13 extends sealingly around the connection 6 and the brazing 14 sealingly around the hole 20. Further, the brazings 13 and 14 can merge into one brazing in the area between the connection 6 and the hole 20.

By means of the brazings 13, 14 a separation zone 15 is provided around the hole between the lower plate 10" of the pair and the upper plate 10'" of the next pair. The separation zone 15 extends in the pack of brazed plates and the separation zone 15 can thus not be reached by either of the media.

FIG. 4 shows the reinforcement means 30 as a threaded screw or bolt, which is arranged through the hole 20 of the plates 10. The reinforcement means 30 comprises at a first end a first stop 32, e.g. a screw head, which is arranged to stop the movement of the reinforcement means 30 towards an upper cover plate 40, protecting plate or the like. Further, a second stop 50 is arranged at the second end of the reinforcement means 30, which stop 50 can be constituted by a nut, whereby reinforcement means 30 can be secured at a bottom plate 42, cover plate or the like. With such an arrangement the reinforcement means 30 may thus be secured at a pack of plates and in that way keep the plates together and constitute a complement to the brazings. It should be understood that the second stop 50 can be constituted by the above-mentioned ring, disc or plate comprising a number of threaded holes which can secure a number of reinforcement means 30 at said pack of plates.

In a heat exchanger according to the present invention, pressure distributing disks 33, 51 can be arranged between the outer plates 40, 42 and said stops 32, 50 to counterbalance the pressure exerted on the outer plates. These disks are preferably thicker than the outer plates. The dimensions of the disks 33, 51 can be varied but they are adapted to counterbalance the pressure exerted on the brazings at the connections 1, 6 in order to avoid or reduce the risk that the brazings break.

Figure 5:
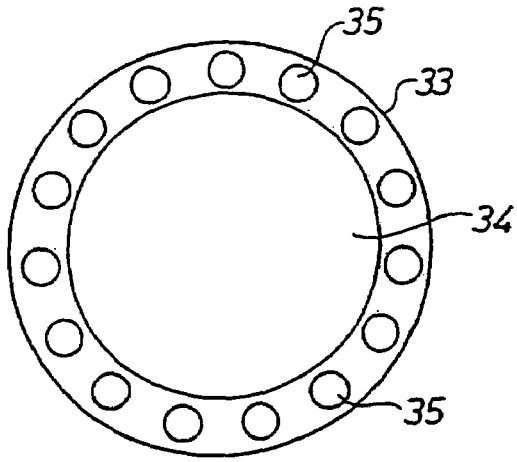
FIG. 5 schematically shows a first pressure distributing disk according to an embodiment of the present invention.

FIG. 4 shows a first pressure distributing disk 33 realized as a cylindrical ring and arranged between the cover plate 40 and the first stop 32 in order to take up the pressure exerted on the cover plate 40. The first disk 33 can be loosely arranged, i.e. not brazed. Further, the first disk 33 can show a thickness in the range of 40 mm, i.e. a thickness that is larger than the plate thickness. The first disk 33 can further have an opening 34 for the connections 1, 6 and a number of holes 35 for the reinforcement means 30, cf. FIG. 5.

Figure 6:
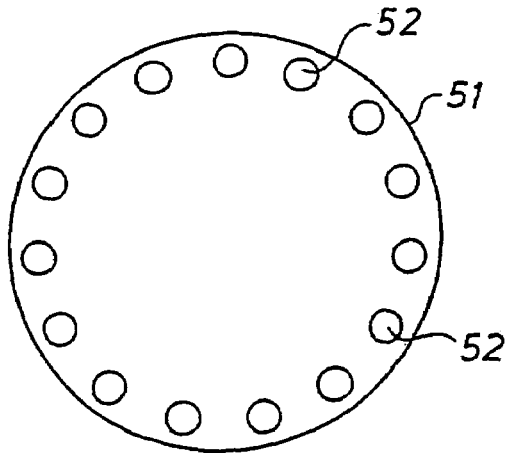
FIG. 6 schematically shows a second pressure distributing disk according to an embodiment of the present invention.

A second pressure distributing disk 51 can further be arranged between the bottom plate 42 and the second stop 50 to take up the pressure exerted on the bottom plate 42. The second disk 51 can also be loosely arranged. The second disk 51 can further be a circular disk with a thickness in the range of 40 mm. The second disk 51 presents a number of holes 52 for the reinforcement means 30, cf. FIG. 6. The holes can either be threaded or unthreaded. When the holes are unthreaded, a nut can be used to fix a reinforcement means and when the holes are threaded, the reinforcement means can be secured directly in the disk 51, whereby the disk 51 functions as a second stop.

In another embodiment of the invention, the first and second disk have a rectangular shape similar to the shape of the plate 10. In this embodiment, the first disk presents a number of openings for connections and a number of holes for the reinforcement means. These openings and holes correspond to the openings 34 and the holes 35, respectively, in the first disk 33. Further, the second disk presents a number of holes for the reinforcement means, which holes correspond to the holes 52 in the second disk 51. As understood by the skilled person, the first and the second disk can have other shapes than rectangular or circular. Also different designs of the first and second disk can be combined.

Figure 7:
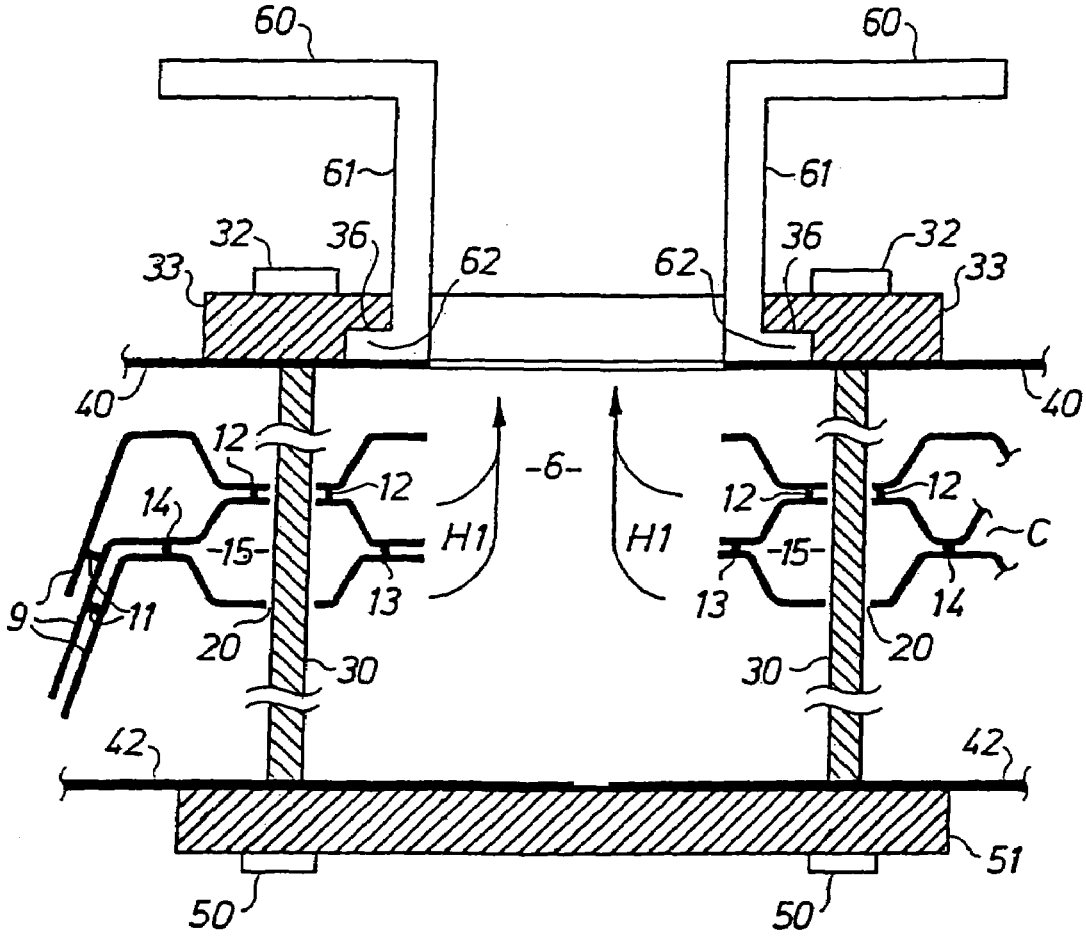
FIG. 7 schematically shows a partial cross-section according to FIG. 4, in which a flange is arranged at an upper cover plate.

In FIG. 7 a partial cross-section similar to the cross-section of FIG. 4 is schematically shown. FIG. 7 shows a flange coupling for connection of tubings. The first pressure distributing disk is formed as a ring 33. The ring 33 is divided so that it may be thread on a flange 60 and an inner edge 62 at a neck 61. The ring presents a recess 36 to receive the inner edge 62 of the flange neck 61. When reinforcement means 30, e.g. bolts, are arranged through the holes 20 in the ring 33, the flange coupling will be secured at the first disk 33. Thus the ring 33 can function as a flange carrier. Further, the flange can in its inner edge 62 of the neck 61 have a packing, such as a copper or rubber packing. This packing can e.g. be arranged between the surface of the inner edge 62 against the upper cover plate 40 or between the surface of the inner edge 62 against the ring 33. The packing prevents the occurrence of leakage between the flange coupling and the upper protecting plate, and can also eliminate and reduce vibrations between the tubings and the heat exchanger.

The first and second pressure distributing disk can e.g. be manufactured of carbon steel or another suitable material.

The present invention refers also to a heat exchanger comprising a number of packs of plates described above, whereby packings of rubber or copper are sealingly arranged between each pack. In an embodiment of the heat exchanger according to the present invention, a pack of plates comprises about 30 plates, but it should be understood that the number of plates can be varied arbitrarily without departing from the scope of the invention.

A flange coupling is suitably arranged at the outermost pack. Several packs of plates can also be connected by means of intermediate flanges and sealings. The flange 60 can then replace the disk 51 between the packs. Thus, flexible connections between several packs are obtained and the flange can further be arranged to eliminate or reduce e.g. vibrations.

The present invention thus provides a heat exchanger comprising several advantages compared to the prior art. The invention allows for fully brazed heat exchangers, which are cheap to be manufactured practically maintenance-free, to be designed larger than what is commonly occurring and thus to be used within a much wider filed of application, thanks to the avoidance of leakage.

Advantageous embodiments of the invention have been described in detail. As is stated above, the invention may be modified in various ways without departing from the scope thereof, as defined by the accompanying claims.

The invention claimed is:

1. A heat exchanger comprising:

plates with a pattern of grooves and connections for inlets and outlets, placed in a pack and brazed to each other, so that separate channels for two media between alternating pair of plates are formed;

a separation zone provided between inner and outer brazings arranged around said connections;

a set of holes arranged through said plates in said separation zone; and at least one reinforcement mechanism arranged through said holes;

wherein said brazings are arranged to seal off said holes toward the channels.

2. A heat exchanger according to claim 1, wherein said holes are arranged in rotational symmetry through the plates, with regard to a 180 degrees rotation.

3. A heat exchanger according to claim 2, wherein each reinforcement mechanism comprises a threaded rod having a first stop at a first end.

4. A heat exchanger according to claim 3, wherein each reinforcement mechanism is arranged to be fixed at said pack by a second stop, having at least one threaded hole in which a second end of the reinforcement mechanism is arranged to be screwed.

5. A heat exchanger according to claim 4, further comprising a pressure distributing disk arranged between an outer plate and said first stop, and wherein said pressure distributing disk has holes for connection.

6. A heat exchanger according to claim 5, wherein said pressure distributing disk comprises a ring having a recess for receiving a flange coupling having a flange with an inner edge at a neck, whereby the inner edge is configured to be arranged at the recess.

7. A heat exchanger according to claim 1, wherein 30 plates are arranged in said pack.

8. A heat exchanger according to claim 1, wherein a number of packs of plates are connected by a packing of rubber or copper between each pack.

9. A heat exchanger according to claim 1, wherein a number of pack of plates are connected by a flange coupling.

* * * * *